US008840487B2

(12) United States Patent
Okot

(10) Patent No.: US 8,840,487 B2
(45) Date of Patent: Sep. 23, 2014

(54) GOLF CLUB WITH ADJUSTABLE SHAFT

(75) Inventor: Alex W. Okot, Amsterdam (NL)

(73) Assignee: Nike, Inc., Beaverton, OR (US)

( * ) Notice: Subject to any disclaimer, the term of this patent is extended or adjusted under 35 U.S.C. 154(b) by 186 days.

(21) Appl. No.: 12/791,250

(22) Filed: Jun. 1, 2010

(65) Prior Publication Data

US 2011/0294591 A1 Dec. 1, 2011

(51) Int. Cl.
*A63B 53/02* (2006.01)

(52) U.S. Cl.
USPC ..... 473/306; 473/307; 473/244

(58) Field of Classification Search
USPC ..... 473/305–307, 313, 314, 244
See application file for complete search history.

(56) References Cited

U.S. PATENT DOCUMENTS

| | | | | | |
|---|---|---|---|---|---|
| 1,334,189 | A | * | 3/1920 | Swanson | 473/306 |
| 2,155,830 | A | | 4/1939 | Howard | |
| 2,644,689 | A | | 7/1953 | Russell | |
| 3,096,982 | A | * | 7/1963 | Bassin | 473/248 |
| 3,368,812 | A | | 2/1968 | Baldwin | |
| 3,392,977 | A | * | 7/1968 | De Lacey | 473/306 |
| 3,430,957 | A | * | 3/1969 | Andis | 473/248 |
| D262,984 | S | * | 2/1982 | Jeghers | D21/740 |
| 5,224,702 | A | | 7/1993 | Turner | |
| 5,292,123 | A | * | 3/1994 | Schmidt et al. | 473/248 |
| 5,390,919 | A | * | 2/1995 | Stubbs et al. | 473/246 |
| D356,846 | S | * | 3/1995 | Murrill | D21/741 |
| 5,497,992 | A | | 3/1996 | Ritke | |
| 5,533,730 | A | * | 7/1996 | Ruvang | 473/251 |
| 5,634,857 | A | | 6/1997 | Bradshaw et al. | |
| D380,798 | S | * | 7/1997 | Novelli | D21/739 |
| 5,722,177 | A | * | 3/1998 | Reilly, III | 33/508 |
| 5,782,005 | A | | 7/1998 | Reilly, III | |
| 5,820,482 | A | * | 10/1998 | Sessions | 473/305 |
| 5,924,938 | A | * | 7/1999 | Hines | 473/307 |
| 7,163,463 | B2 | | 1/2007 | Mills | |
| 7,429,218 | B2 | | 9/2008 | Pinder | |
| 2002/0072430 | A1 | * | 6/2002 | Bullock et al. | 473/313 |
| 2003/0220149 | A1 | | 11/2003 | Mills | |
| 2006/0172816 | A1 | * | 8/2006 | Johnson | 473/334 |

FOREIGN PATENT DOCUMENTS

| | | | | |
|---|---|---|---|---|
| GB | 1232651 | A | | 5/1971 |
| GB | 2175510 | A | | 12/1986 |
| JP | 2007222257 | A | * | 9/2007 |

OTHER PUBLICATIONS

International Search Report and Written Opinion mailed Mar. 26, 2012 in PCT Application No. PCT/US2011/035151.

* cited by examiner

*Primary Examiner* — Stephen L. Blau
(74) *Attorney, Agent, or Firm* — Banner & Witcoff, Ltd.

(57) ABSTRACT

Golf club, golf club shaft and golf club head structures are presented. The golf club may include an adjustable shaft configured to be received in a slot formed in a crown of the golf club head. In some examples, the slot may include a plurality of receivers, such as apertures, configured to receive the shaft in various positions along the length of the slot. The various positions may be progressively closer to a central area of the ball striking surface in order to increase the power transferred to the ball upon striking it.

16 Claims, 7 Drawing Sheets

GOLF CLUB WITH ADJUSTABLE SHAFT

FIELD OF THE INVENTION

The present invention relates generally to golf clubs and golf club heads. Particular example aspects of this invention relate to a golf club having an adjustable shaft that may be secured in various positions along the club head to provide additional power when striking a ball.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Even the best golfers desire additional power when striking a golf ball. Conventional golf club arrangements position the shaft near the heel of the golf club head which may reduce the amount of power transferred from the golf club to the ball during a swing. Accordingly, a golf club that may allow a user to position the shaft nearer the central or ball striking surface of the golf club head may be advantageous.

SUMMARY OF THE INVENTION

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below Aspects of this invention relate to golf club, golf club shaft, and golf club head structures that may allow for adjustment of the position of the shaft relative to the ball striking surface of the golf club head. In some examples, the golf club head may include a slot or groove configured to receive the shaft. In some arrangements, the slot or groove may include a plurality of apertures into which the shaft may be received and secured to the golf club head. In some examples, the slot may include a lip or edge to aid in maintaining the shaft within the slot.

The shaft may be adjustable between two or more positions within the slot. For instance, the shaft may be adjusted between a first position near the heel of the golf club head and at least a second position closer to and proximate to a central portion of the front face of the golf club head. Movement of the shaft closer to the center of the ball striking surface of the golf club head may aid in transferring additional power from the golf club to the golf ball which may aid in increasing the distance the ball may travel.

BRIEF DESCRIPTION OF THE DRAWINGS

The present invention is illustrated by way of example and not limited in the accompanying figures, in which like reference numerals indicate similar elements throughout, and in which.

Figure 1A:
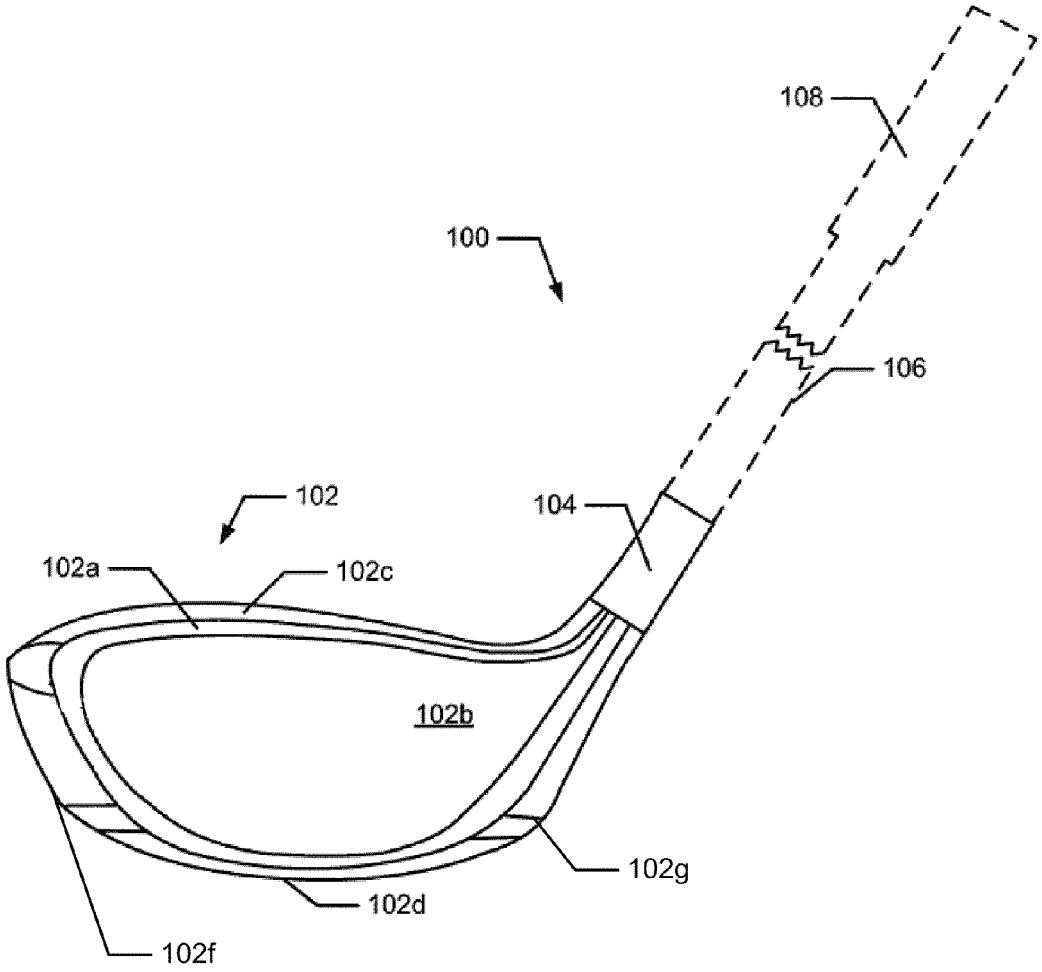
FIGS. 1A and 1B generally illustrate features of golf club and golf club head structures according to at least some examples of this invention.

The reader is advised that the various parts shown in these drawings are not necessarily drawn to scale.

DETAILED DESCRIPTION

The following description and the accompanying figures disclose features of golf clubs, golf club shafts, and golf club head structures in accordance with examples of the present invention.

I. GENERAL DESCRIPTION OF EXAMPLE GOLF CLUBS, GOLF CLUB HEADS AND GOLF CLUB SHAFTS IN ACCORDANCE WITH THIS INVENTION

Aspects of this invention relate to golf clubs having a golf club head and a shaft. In some examples, the shaft may be adjustably connected to the golf club. In at least some arrangements, the golf club head may include a slot arranged in a crown of the golf club head and extending from a heel of the golf club head toward a toe of the golf club head. In some examples, the slot may be configured to receive the shaft in at least a first position along the crown of the golf club head and a second position along the top or crown of the golf club head, wherein the first position is closer to the central region of the golf club head than the second position.

Additional aspects of this invention relate to a golf club having a shaft adjustably connected to the golf club. The golf club may further include a golf club head having at least a top or crown, a bottom or sole, a toe, a heel, a rear, a front face and a ball striking surface forming at least a portion of the front face. In some examples, the golf club head may further include a slot formed in the crown and extending from the heel toward the toe along and vertically above the front face of the golf club head. In some arrangements, the slot may terminate in the crown vertically above a generally central portion of the front face. In at least some examples, the slot may be configured to receive the shaft in at least a first position located near the heel of the golf club head and a second position located nearer the central portion of the front face than the first position. In some examples, the slot may include a plurality of receivers, such as apertures, configured to receive the shaft in various positions along the crown of the golf club head. In other examples, the slot may include one or more rails configured to aid in maintaining the position of the shaft within the slot.

Still other aspects of the invention relate to a golf club including a golf club head having at least a top or crown, a bottom or sole, a toe, a heel, a rear, a front face and a ball striking surface forming at least a portion of the front face. The golf club head may further include a slot formed in the crown of the golf club head. In some examples, the slot may include a plurality of apertures. The golf club may further include a shaft adjustably connected to the golf club head. In some arrangements, the shaft may be configured to mate with the plurality of apertures formed in the slot. In at least some examples, the shaft may be adjustable between at least: a first position located in the heel of the golf club head; a second position located vertically above a generally central portion of the ball striking surface; and a third position located between the first position and the second position.

Still other aspects may relate to a golf club head configured to mate with a shaft. The golf club head may include a golf club head body including a crown, a sole, a toe, a heel, a rear and a front face including a ball striking surface. The golf club head may further include a plurality of receivers formed in the crown of the golf club head body, the receivers being configured to receive the shaft in at least a first and second position, the first position being more proximate a central region of the ball striking surface than the second position. In some examples, the plurality of receivers include apertures. In still other examples, the plurality of receivers are formed in a slot formed in the crown of the golf club head.

Given the general description of various example aspects of the invention provided above, more detailed descriptions of various specific examples of golf clubs, golf club shaft and golf club head structures according to the invention are provided below.

II. DETAILED DESCRIPTION OF EXAMPLE GOLF CLUBS, GOLF CLUB HEADS AND GOLF CLUB SHAFTS ACCORDING TO THE INVENTION

The following discussion and accompanying figures describe various example golf clubs sleeves in accordance with the present invention. When the same reference number appears in more than one drawing, that reference number is used consistently in this specification and the drawings to refer to the same or similar parts throughout.

Various golf club heads and golf club shafts in accordance with aspects described herein may be used with various types of golf clubs. For instance, the adjustable shaft may be used with wood-type golf clubs and golf club heads, e.g., clubs and club heads typically used for drivers and fairway woods, as well as for "wood-type" utility or hybrid clubs, or the like. Such club head structures may have little or no actual "wood" material and still may be referred to conventionally in the art as "woods" (e.g., "metal woods," "fairway woods," etc.). The adjustable golf club shaft may also be used with iron-type, hybrid-type, utility type, etc. golf clubs and golf club head structures.

Golf club heads may generally include a plurality of different regions, segments, portions, ends, etc. In an example embodiment, a golf club head may generally include a front face, a rear, a toe, a heel, a crown and a sole that may, generally, define an interior or interior cavity of the golf club head. The golf club heads may include a multiple piece construction and structure, e.g., including one or more of a sole, a front face (optionally including a ball striking surface that may be integrally formed therein or attached thereto), a top or crown, a bottom or sole, a rear, etc. Of course, if desired, various portions of the club head structure may be integrally formed with one another, as a unitary, one piece construction, without departing from the invention (e.g., the front face and/or rear may be integrally formed with the sole and/or crown, etc.). Optionally, if desired, the various portions of the club head structure (such as the sole, the crown, the front face, the rear, etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a front face may be attached to a one piece club head body (optionally, a hollow body, etc.). More specific examples and features of golf club heads and golf club structures according to this invention will be described in detail below in conjunction with the example golf club structures illustrated in FIGS. 1 through 7.

Figure 1B:
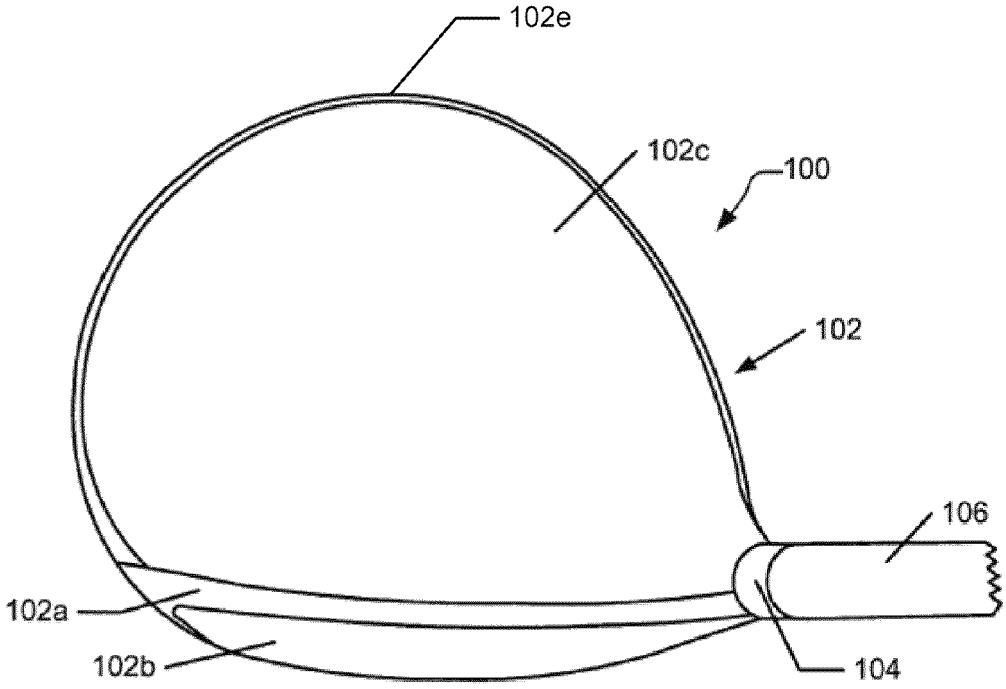

FIGS. 1A and 1B generally illustrate an example wood-type golf club 100 and/or golf club head 102 in accordance with this invention. As mentioned above, aspects of the adjustable golf club shaft described herein may be used with various other types of golf clubs and golf club head structures, including hybrid type clubs, iron-type clubs, and the like. Although the general description of golf club structures found in FIGS. 1A and 1B is generally directed to wood-type golf club heads, nothing in the disclosure should be viewed as limiting use of the adjustable golf club shaft as described herein to use with only wood-type golf clubs. Instead, the golf club shafts, golf club heads, etc. described herein may be used with various types of golf clubs without departing from the invention.

In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel (e.g., provided within an interior chamber defined by the club head 102), etc.), as will be discussed more fully below. The shaft 106 may be received in, engaged with, and/or attached to the golf club head in various adjustable manners which permit movement of the shaft 106 along the golf club head 102, as will be discussed more fully below.

The shaft 106 may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

The club head 102 itself also may be any of various types of golf club heads and may be constructed in any suitable or desired manner and/or from any suitable or desired materials without departing from this invention, including from conventional materials and/or in conventional manners known and used in the art. For example, in the exemplary structure 102 shown in FIGS. 1A and 1B, the club head 102 includes a front face 102*a* that defines a ball striking surface 102*b* (the ball striking surface 102*b* may optionally comprise a plate that may be integrally formed with the front face 102*a* or attached to the club 100 such that the ball striking surface plate and a frame member together constitute the overall front face 102*a*). The club head 102 of this illustrated example further includes a crown 102*c*, a sole 102*d*, a rear 102*e*, a toe 102*f*, and a heel 102*g*. A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown 102*c*, sole 102*d*, rear 102*e*, etc.) may be made from any desired materials and combinations of different materials, including materials that are conventionally known and used in the art, such as metal materials, including lightweight metal materials. More specific examples of suitable lightweight metal materials include steel, titanium and titanium alloys, aluminum and aluminum alloys, magnesium and magnesium alloys, etc.

As additional examples or alternatives, in order to reduce the weight of the club head 102, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. The composite or other non-metal material(s) may be incorporated as part of the club head structure 102 in any desired manner, including in conventional manners that are known and used in the art.

The various individual parts that make up a club head structure 102, if made from multiple pieces, may be engaged with one another and/or held together in any suitable or desired manner, including in conventional manners known and used in the art. For example, the various parts of the club head structure 102, such as the front face 102*a*, the ball striking surface 102*b*, the crown 102*c*, the sole 102*d*, the rear 102*e*, etc. may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 (e.g., the edges where members 102*a*, 102*b*, 102*c*, 102*d*, 102*e*, 102*f*, 102*g*, etc. contact and join to one another) may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention.

In some conditions, it may be advantageous to provide a golf club head with a shaft that may be adjusted between a conventional position near the heel end of the golf club head and one or more positions located in a more central region of the golf club head. Although much of the power may be generated near the region where the shaft meets the golf club head, the ball may be actually struck in a more central region of the club head. This may reduce the power transferred to the ball upon striking which may cause the ball to lose distance. By joining the shaft to the golf club head in an area closer to the ball striking portion of the golf club, more power may be transferred to the ball during a swing, thereby causing the ball to travel a greater distance.

Figure 2:
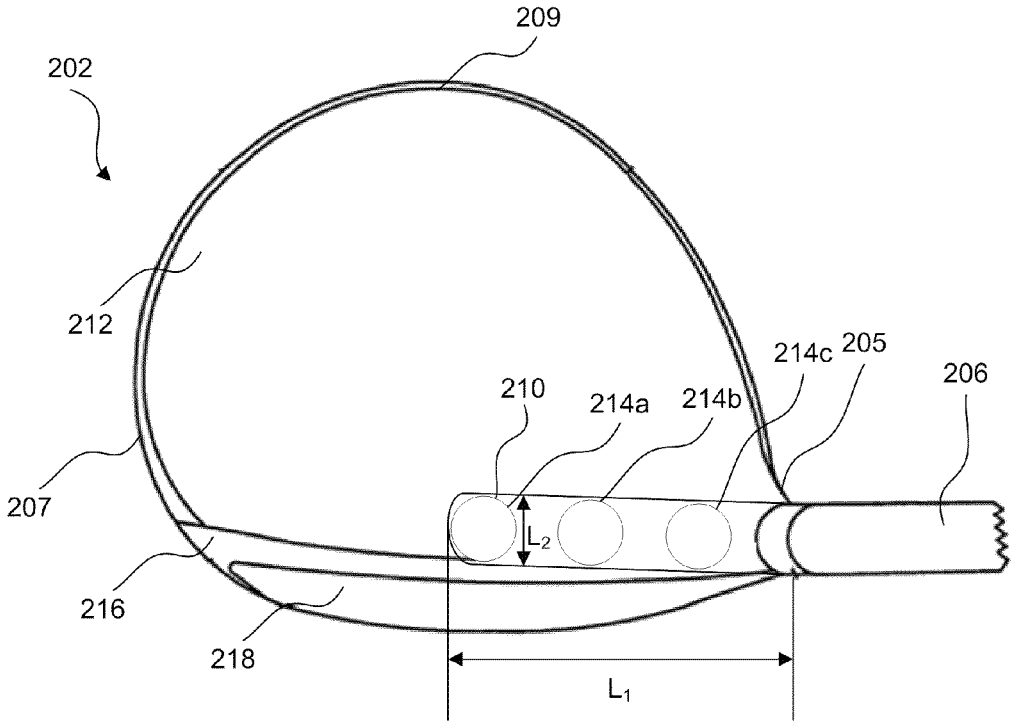
FIG. 2 illustrates one example golf club head having an adjustable shaft according to at least some examples of this invention.

FIG. 2 illustrates a top view of one example golf club head 202 having an adjustable shaft 206. The golf club head 202 may be any suitable golf club head, such as a wood-type golf club head, and may be formed using any of the methods, arrangements, etc. described above. In addition, the golf club head 202 may include a slot 210 or other recess formed in the crown 212 of the golf club head 202. The slot 210 may be an open slot 210 or may have a lip or edge (as shown in FIG. 4B) to aid in securing the shaft 206 to the golf club head 202. In some examples, the slot 210 may be formed in the golf club head 202 during manufacture of the golf club head, such as during molding or formation of the top or crown of the golf club head 202. In other examples, the slot 210 may be cut into the crown of the golf club head 202 during manufacture or after, as desired.

In some arrangements, the slot 210 may be formed in the crown 212 of the golf club head 202 and may be positioned vertically above the front face 216 and/or ball striking surface 218 of the golf club head 202. That is, the slot 210 may be formed in the crown 212 and may run along the front face 216 of the golf club head. In some examples, the slot 210 may extend from a heel 205 of the golf club head toward a toe 207 of the golf club head. In some arrangements, the slot 210 may extend from the heel 205 toward the toe 207 and may terminate at a point vertically above and generally proximate to a central portion of the front face 216. In at least one arrangement, the slot 210 may terminate at a point vertically above the center of the front face 216.

In some examples, the slot 210 may be between 0.5 and 2.0 inches long (e.g., in a first direction along the front face 216 as shown by length $L_1$) and may be between 0.25 and 1.0 inches wide (e.g., in a second direction extending from the front face 216 toward a rear 209 of the golf club head 202 as shown by length $L_2$). The slot 210 may be configured to receive the shaft 206, for instance, in one or more receivers, and may be configured to permit adjustment of a position of the shaft 206. For instance, the slot 210 may include a plurality of receivers, such as apertures 214*a*-214*c*, into which the shaft 206 may be received. Positioning of the shaft 206 within one of apertures 214*a*-214*c* may adjust the position of the shaft 206 with respect to the golf club head 202 and, in particular, the ball striking region 218 of the golf club head. As the shaft 206 is moved closer to a central region (e.g., ball striking region) of the golf club head 202 along the slot 210, more power may be transferred from the golf club to a ball during a golf swing.

In the arrangement of FIG. 2, the shaft 206 is shown in a first position that may be considered a traditional shaft position arrangement. That is, the shaft 206 is connected to the golf club head 202 near or proximate to a heel 205 of the golf club head 202. This arrangement may place the primary power generated at an area where the shaft 206 meets the golf club head 202 that may be generally offset from the ball striking surface 218 of the golf club head 202. The shaft 206 may be removed from the first position (such as in aperture 214*c*) and adjusted to another position that may be closer to a central region of the golf club head 202. For instance, the shaft 206 may be inserted into apertures 214*b* or 214*a* in order to position the shaft 206 closer to the ball striking surface 218 of the golf club head 202, thereby increasing the power transferred from the golf club to the ball which may increase the distance a ball may be hit. In some examples, the shaft 206 may be slidable along the slot 210 in order to adjust the position of the shaft 206 within the slot 210.

Figure 6:
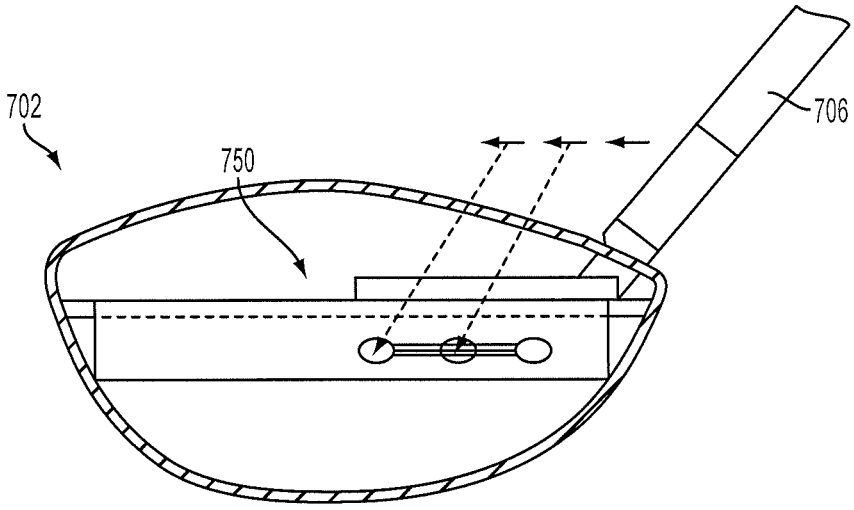
FIG. 6 illustrates an example shaft adjustment system according to at least some examples of this invention.

In some examples, the shaft 206 may include a threaded end which mates with a corresponding thread within the aperture 214*a*-214*c* on the golf club head 202 in order to secure the shaft 206 to the golf club head 202. In some examples, a stop may be used to prevent the shaft 206 from completely disconnecting from the golf club head 202. Instead, the stop may maintain a connection between the shaft 206 and, in some examples, the slot 210, to aid in adjustment of the shaft 206 relative to the golf club head 202. In other examples, the shaft 206 may employ another mechanical connector in order to removably secure the shaft 206 to the golf club head 202. For instance, quick disconnect connectors may be used, a button release may be used, etc. In still other examples, a gear type connection may be used. FIG. 6 illustrates one example gear type shaft adjustment system 750 that may be used in accordance with at least some examples of the invention. Similar to the arrangement above, the golf club head 702 may include a slot (similar to the slots described above). A sliding gear system 750 may be contained within the slot and may allow adjustment of the shaft 706 between multiple positions. For instance, the shaft 706 may slide along a gear system 750 and may lock in place in various positions along the golf club head 702.

Figure 4:
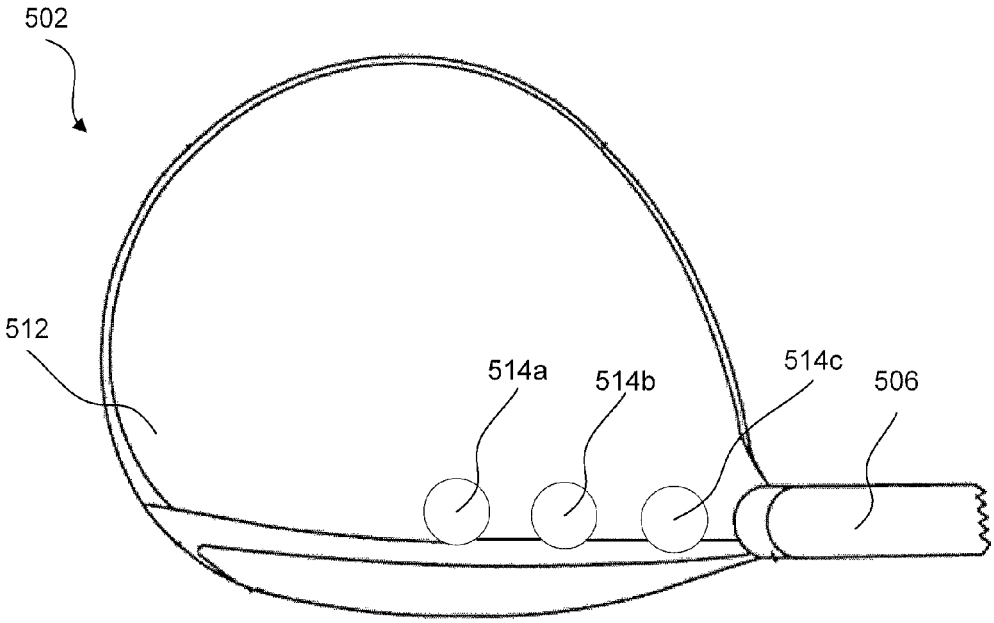
FIG. 4 illustrates yet another golf club head having an adjustable shaft according to at least some examples of this invention.

Although the arrangement of FIG. 2 is described as having a slot 210 with apertures 214 arranged within the slot 210, in some examples, the golf club head 202 may not include a slot 210 and instead may have a plurality of receivers formed directly in the crown of the golf club head that are configured to receive the shaft 206 in various positions along the crown of the golf club head. FIG. 4 illustrates one example arrangement of a golf club head 502 having a plurality of receivers, such as apertures 514*a*-514*c*, formed in the crown 512. Similar to the arrangement of FIG. 2, the apertures 514*a*-514*c* are configured to receive the shaft 506 in various positions along the top surface 512 of the golf club head 502. In some examples, the shaft 506 and apertures 514*a*-514*c* may have a threaded arrangement such that the shaft 506 may be connected to and/or secured to the golf club head 502 via a mating thread in the apertures 514*a*-514*c*. Additionally or alternatively, other mechanical or other fasteners may be used to secure the shaft 506 to the golf club head 502 in various positions.

In some examples, the angle of the shaft relative to the golf club head may remain constant as the shaft moves through various positions along the golf club head. For instance, although the shaft may move or shift closer to a center of the golf club head, the angle of the shaft relative to the golf club head may remain constant or substantially constant throughout the various positions along the golf club head. In other examples, the angle of the shaft relative to the golf club head may also be adjustable via the shaft adjustment system described herein.

Figure 3A:
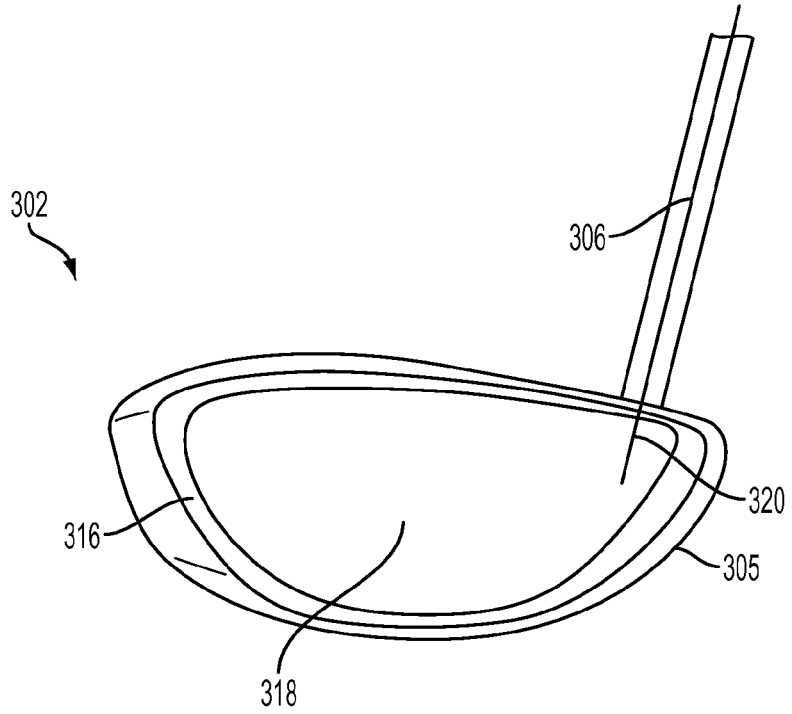
FIGS. 3A-3C illustrate another example golf club head having an adjustable shaft and illustrating the adjustable shaft in various positions according to at least some examples of this invention.
Figure 3B:
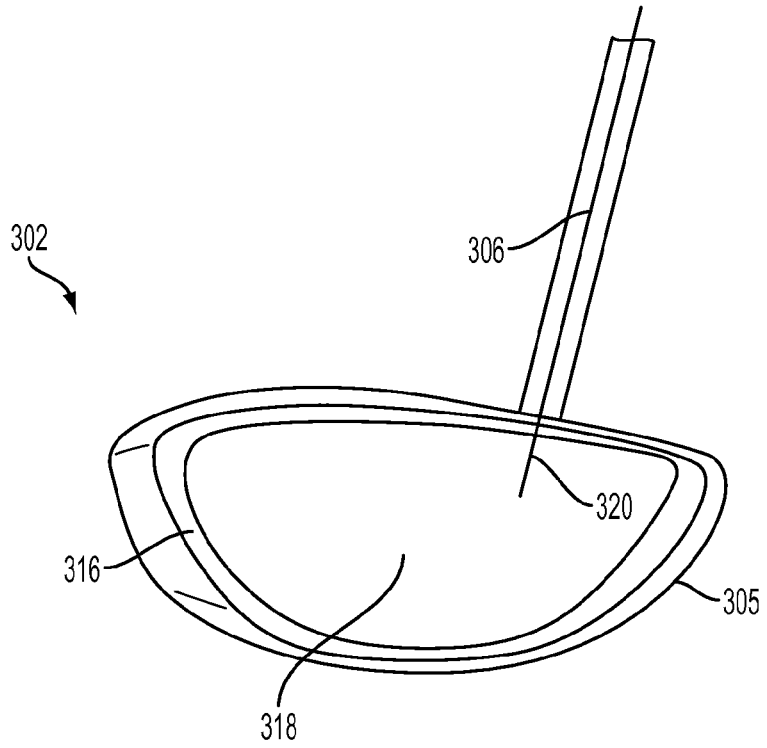
Figure 3C:
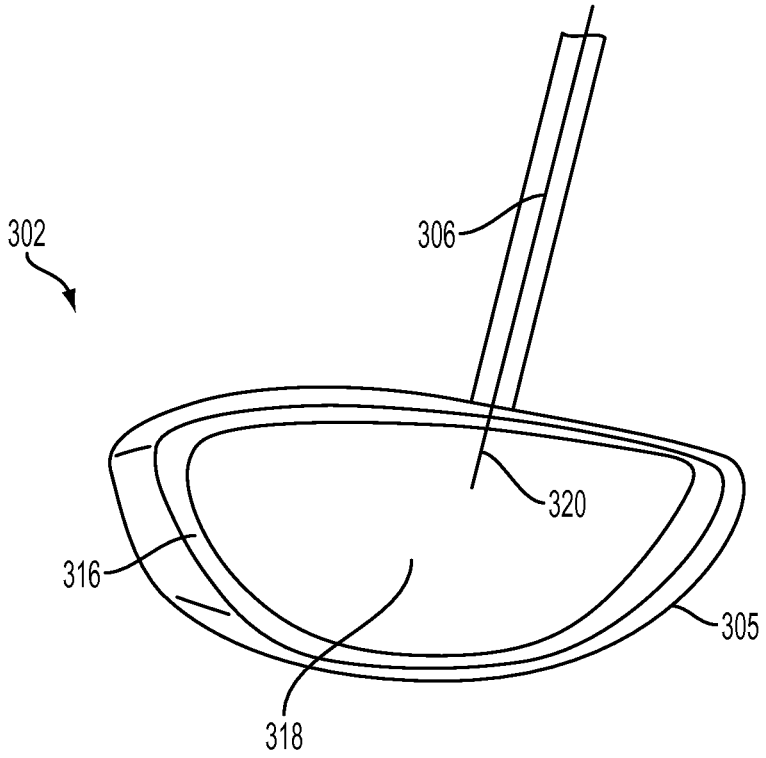

FIGS. 3A-3C illustrate front views of a golf club head 302 similar to the golf club head 202 of FIG. 2. As shown in FIGS. 3A-3C, the position of the shaft 306 may be adjusted. FIG. 3A illustrates a first position of the shaft 306 connected to the golf club head 302. The shaft 306 is shown in a generally conventional position near the heel end 305 of the golf club head 302. The shaft 306 may include a longitudinal axis (indicated by line 320) extending along the length of the shaft 306. As shown in FIG. 3A, an extension of this longitudinal axis 320 may extend through a portion of the front face 316 near the heel 305 of the golf club head 302. That is, the longitudinal axis 320 generally does not extend through a central, ball striking surface 318 of the golf club head 302.

FIG. 3B illustrates the shaft 306 in a second position within the golf club head 302. This second position is generally closer to a central portion 318 of the front face 316 of the golf club head 302. This arrangement may provide additional power transfer from the golf club to the golf ball during a golf swing because the shaft 306 is positioned closer to the ball striking surface 318. In FIG. 3B, an extension of the longitudinal axis 320 of the shaft 306 may extend through a portion of the front face 316 that is nearer the central, ball striking surface 318. In some examples, the axis 320 may extend through or be aligned with a portion of the ball striking surface 318. For instance, the axis 320 may be aligned with a portion of the ball striking surface 318 that is offset from the center of the ball striking surface 318.

FIG. 3C illustrates yet another shaft 306 position. This third position is generally closer to a central portion of the front face 316 than the first and second positions shown in FIGS. 3A and 3B, respectively. This arrangement may provide additional power transfer from the golf club to the golf ball during a golf swing by positioning the shaft 306 nearer the ball striking surface 318. In the arrangement of FIG. 3C, an extension of the longitudinal axis 320 would generally extend through or align with the ball striking surface 318 of the golf club head 302. In some examples, the axis 320 may extend through or be aligned with a center or central region of the ball striking surface 318.

Although three positions are shown in the shaft 306 arrangements of FIGS. 3A-3C, more or fewer positions may be provided without departing from the invention. For instance, two shaft positions may be available. Alternatively, four, five or more shaft positions may be available.

Figure 5:
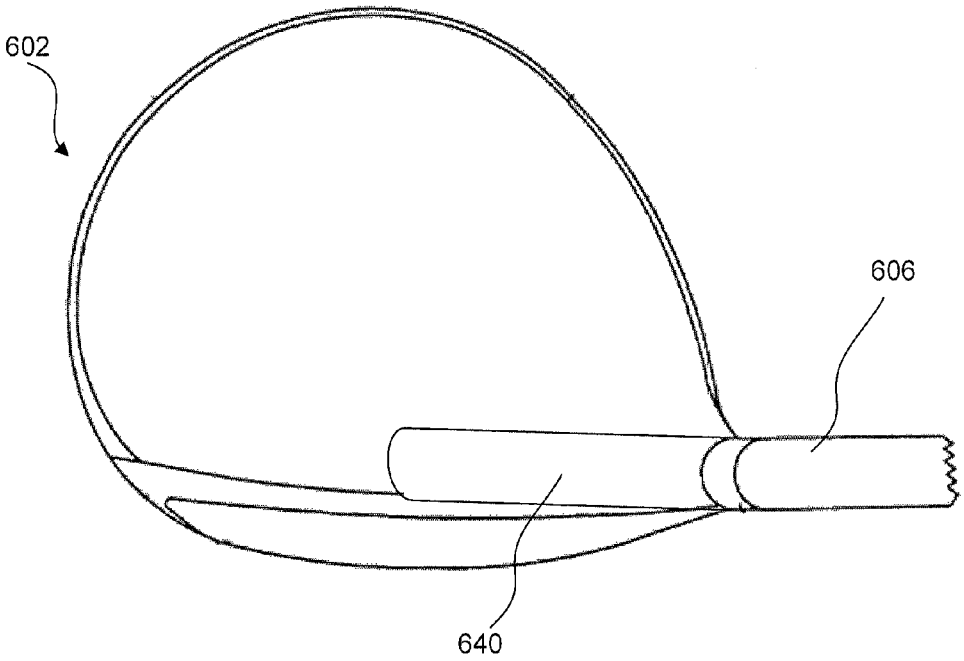
FIG. 5 illustrates one example golf club head having a cover over a portion of a slot according to at least some examples of this invention.

In some examples, one or more removable covers may be used to cover at least a portion of the slot formed in the golf club head. FIG. 5 illustrates one example of golf club head 602 having a removable cover 640 covering at least a portion of the slot (not shown). The removable cover may aid in preventing dirt, debris, etc. from entering the slot. In some examples, one or more covers may be provided and may be used with various shaft positions within the slot. The cover 640 may be held in place using known methods of connection, such as mechanical fasteners, snap fits, and the like.

The adjustable shaft arrangements described above provide a variety of advantages to players. For instance, positioning the shaft nearer the center of the ball striking surface provides power at the primary point of contact, thereby transferring more power to a ball when it is struck which may cause the ball to travel a greater distance. In addition, positioning the shaft nearer the center of the ball striking surface may aid in improved alignment of a players swing with the ball target area of the ball striking surface because the shaft may be aligned with the target area. Further, failure to strike the ball in the target area (e.g., in the center of the ball striking surface) may still result in improved power with the shaft nearer the center of the ball striking surface because secondary power regions (such as areas just off the target portion of the ball striking surface) will still receive increased power due to the shaft being nearer the target area.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 6 may be used individually and/or in any combination or subcombination without departing from this invention.

What is claimed is:

1. A golf club, comprising:

a shaft; and a wood-type golf club head, the shaft being adjustably connected to the golf club head, the golf club head including a slot arranged in a crown of the golf club head and extending from a heel of the golf club head toward a toe of the golf club head, the slot being configured to receive a lowermost free end of the shaft in at least a first position along the crown of the golf club head and a second position along the crown of the golf club head, wherein the first position is closer to the central region of the golf club head than the second position, and wherein an angle of the shaft with respect to the golf club head is the same in the first position and the second position.

2. The golf club of claim 1, wherein the slot includes a plurality of apertures into which the shaft is received.

3. The golf club of claim 2, wherein the plurality of apertures includes at least three apertures.

4. The golf club of claim 2, wherein the plurality of apertures includes no more than four apertures.

5. The golf club of claim 1, wherein the slot is between 0.5 and 2.0 inches in length.

6. The golf club of claim 1, wherein the slot is between 0.25 and 1.0 inches wide.

7. The golf club of claim 1, wherein the slot includes a lip configured to maintain the position of the shaft within the slot.

8. The golf club of claim 1, wherein the slot extends along the crown along a front face of the golf club head.

9. The golf club of claim 8, wherein the slot extends from the heel toward the toe and terminates in a central region of the golf club head.

10. A golf club, comprising:

a shaft; and a wood-type golf club head, the shaft being adjustably connected to the golf club head, the golf club head having at least a crown, a sole, a toe, a heel, a rear, a front face and a ball striking surface forming at least a portion of the front face, the golf club head further including a slot formed in the crown and extending from the heel toward the toe along and vertically above the front face of the golf club head, the slot terminating in the crown vertically above a generally central portion of the front face, the slot being configured to receive a lowermost free end of the shaft in at least a first position located proximate the heel of the golf club head and a second position located nearer the central portion of the front face than the first position, and wherein an angle of the shaft with respect to the golf club head is the same in the first position and the second position.

11. The golf club of claim 10, wherein the slot includes a plurality of apertures into which the shaft is received.

12. The golf club of claim 11, wherein the plurality of apertures includes at least three apertures.

13. The golf club of claim 11, wherein the plurality of apertures includes no more than four apertures.

14. The golf club of claim 10, wherein the slot is between 0.5 and 2.0 inches in length.

15. The golf club of claim 10, wherein the slot is between 0.25 and 1.0 inches wide.

16. The golf club of claim 10, wherein the slot includes a lip configured to maintain the position of the shaft within the slot.

* * * * *